US006644293B2

(12) United States Patent
Jong

(10) Patent No.: US 6,644,293 B2
(45) Date of Patent: Nov. 11, 2003

(54) PAINTBALL MARKER LOADER APPARATUS

(76) Inventor: Paul Garfield Jong, 1661 Dennison Street, Markham, Ontario (CA), L3R 0N5

( * ) Notice: Subject to any disclaimer, the term of this patent is extended or adjusted under 35 U.S.C. 154(b) by 14 days.

(21) Appl. No.: 09/901,589

(22) Filed: Jul. 11, 2001

(65) Prior Publication Data

US 2003/0010330 A1 Jan. 16, 2003

(51) Int. Cl.[7] ..... F41B 11/02

(52) U.S. Cl. ..... 124/52

(58) Field of Search ..... 124/45, 48, 49, 124/51.1, 52, 73, 74

(56) References Cited

U.S. PATENT DOCUMENTS

| | | | | |
|---|---|---|---|---|
| 3,111,121 A | * | 11/1963 | Baggott | |
| 3,142,294 A | * | 7/1964 | Baldwin | |
| 5,282,454 A | | 2/1994 | Bell et al. | 124/49 |
| 5,511,333 A | | 4/1996 | Farrell | |
| 5,613,483 A | | 3/1997 | Lukas et al. | |
| 5,634,456 A | | 6/1997 | Perrone | |
| 5,640,945 A | | 6/1997 | Slonaker et al. | |
| 5,727,538 A | | 3/1998 | Ellis | |
| 5,794,606 A | | 8/1998 | Deak | |
| 5,809,983 A | | 9/1998 | Stoneking | |
| 5,816,232 A | | 10/1998 | Bell | 124/51.1 |
| 5,823,173 A | | 10/1998 | Slonaker et al. | |
| 5,878,736 A | | 3/1999 | Lotuaco, III | |
| 5,881,707 A | | 3/1999 | Gardner, Jr. | |
| 5,954,042 A | | 9/1999 | Harvey | 124/51.1 |
| 5,967,133 A | | 10/1999 | Gardner, Jr. | |
| 6,003,504 A | | 12/1999 | Rice et al. | |
| 6,035,843 A | | 3/2000 | Smith et al. | |
| 6,065,460 A | | 5/2000 | Lotuaco, III | |
| 6,213,110 B1 | | 4/2001 | Christopher et al. | 124/51.1 |
| 6,273,079 B1 | * | 8/2001 | Jzn | 124/49 |
| 6,311,682 B1 | | 11/2001 | Rice et al. | |
| 6,343,599 B1 | | 2/2002 | Perrone | |
| 6,349,711 B1 | | 2/2002 | Perry et al. | |
| 6,374,819 B1 | | 4/2002 | Ming-Hsien | |

(List continued on next page.)

FOREIGN PATENT DOCUMENTS

| | | |
|---|---|---|
| RU | 2166721 | 5/2001 |

* cited by examiner

*Primary Examiner*—John A. Ricci
(74) *Attorney, Agent, or Firm*—Bereskin & Parr

(57) ABSTRACT

In one aspect, the invention is directed to a loader apparatus for use with a paintball marker including a base attachable to the marker, a cartridge removably attachable to the base and a delivery conduit. The base includes a motor, which drives a driven means ending in a first gear. The cartridge includes a paintball chamber with an outlet, and a flow assistor driven by a second gear that meshes with the first gear on the base. The chamber includes a pressure plate and spring assembly which pushes the paintballs in the chamber towards the outlet. The flow assistor includes a rotating generally funnel-shaped surface having bosses and dimples to enhance the agitation of paintballs and to assist the flow of paintballs from the chamber. The operation of the flow assistor is controlled by a controller. The controller receives input from an on/off switch on the base, a second switch which senses the presence of a cartridge on the base, and a plurality of paintball sensors located in the delivery conduit. Magnetic plates mounted in the cartridge and in the base mate to each other when the cartridge is mounted to the base, helping to hold them together. Similarly, the base includes an external battery pack which is mounted to the base by a magnetic plate arrangement. A tube mounted in the base communicates with the paintball outlet of the chamber, and with the paintball inlet of the paintball marker.

45 Claims, 7 Drawing Sheets

U.S. PATENT DOCUMENTS

| | | | |
|---|---|---|---|
| D459,767 | S | 7/2002 | Rushton |
| 6,415,781 | B1 | 7/2002 | Perrone |
| 6,418,919 | B1 | 7/2002 | Perrone |
| 6,439,217 | B1 | 8/2002 | Shih |
| 6,467,473 | B1 | 10/2002 | Kostiopoulos |
| 6,470,872 | B1 | 10/2002 | Tiberius et al. |
| 6,474,326 | B1 | 11/2002 | Smith et al. |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 2002/0020402 | A1 | 2/2002 | Kotsiopoulos |
| 2002/0170552 | A1 | 11/2002 | Gardner, Jr. |

* cited by examiner

PAINTBALL MARKER LOADER APPARATUS

FIELD OF THE INVENTION

The present invention relates to loader apparatuses for paintball markers, and more particularly the invention relates to apparatuses which include removable paintball cartridges.

BACKGROUND OF THE INVENTION

Paintball games are today played with sophisticated paintball markers that can shoot as fast as the finger can pull the trigger. The marker is equipped with a fixed bulk loader which is mounted onto the paintball inlet of the marker. The paintballs are gravity fed from the loader into the paintball inlet of the marker often with the aid of a motorized flow assistor paddle or wheel located in the loader. The flow assistor is activated when a sensor in the neck of the loader senses an absence of paintballs leading down into the paintball inlet of the marker.

Many problems exist with these conventional loaders. Because the paintballs are gravity fed, the paintball marker must be held in a substantially vertical orientation in order that paintballs can be fed into the marker. As the angle of orientation of the marker changes away from the vertical, the efficiency of the paintball feed is reduced. At some critical angle, which varies depending on the design of the loader, paintball feed into the inlet of the marker, stops completely, making the marker ineffective. Furthermore, the sensors located in the neck of the loader, upon detecting the lack of paintball flow, will activate the flow assistor in an attempt to initiate paintball flow. The noise caused by the flow assistor actuation can inadvertently give away the location of the game player to others. While the activation of the flow assistor is important to maintain paintball flow, it is also important that the activation be kept infrequent to reduce the risk of disclosing the player's location to others. Furthermore, when a player moves a marker with a partially full loader, the paintballs inside the loader can rattle, also giving away the player's location.

Another common problem with conventional loaders is that the process for refilling an empty loader is both cumbersome and time consuming. The end cap on the loader must be opened and the player must fill the loader by pouring paintballs from a paintball storage tube which is carried on the player's belt. The reloading process, while slow, is also prone to causing unwanted noise.

Another problem with conventional loaders is that the power source for the motor can fail during play, and is difficult and time consuming to replace.

Consequently, there is a need for a paintball loader apparatus for a marker that enables the marker to be operated in any orientation, that reduces unwanted noise from the flow assistor device and from the paintballs, and that enables the player to reload the loader with new paintballs and with a fresh power source quickly.

SUMMARY OF THE INVENTION

In a first aspect, the invention is directed to a loader apparatus for use with a paintball marker having a paintball inlet, whereby the loader apparatus includes a base attachable to the paintball marker, a cartridge removably attachable to the base, and a delivery conduit. The base includes a motor which drives a first driven means. The cartridge includes a chamber for paintballs, the chamber defining a paintball outlet, and having a second driven means which is operatively connected to a flow assistor. The second driven means connects to the first driven means when the cartridge is attached to the base. The delivery conduit is in flow communication with the paintball outlet of the chamber and with the paintball inlet of the paintball marker when the cartridge is attached to the base and the base is mounted on the paintball marker.

In a preferred embodiment of this aspect of the invention, the loader may further include a pressurizing member in the chamber of the cartridge. The pressurizing member pushes paintballs in the chamber towards the paintball outlet.

In a second aspect, the invention is directed to a loader apparatus for use with a paintball marker having a paintball inlet, the loader apparatus including a cartridge and a delivery conduit. The cartridge includes a chamber for paintballs, the chamber defining a paintball outlet, and a pressurizing member for maintaining a force on the paintballs in the chamber towards the paintball outlet. The delivery conduit is in flow communication with the paintball outlet of the chamber, and with the paintball inlet of the paintball marker when the loader is attached to the paintball marker.

In a third aspect, the invention is directed to a loader apparatus for use with a paintball marker having a paintball inlet. The loader apparatus includes a cartridge having a chamber for paintballs having a paintball outlet, a rotatable flow assistor, a delivery conduit, a motor and driven means. The rotatable flow assistor has a funnel shaped agitation surface for agitating paintballs. The agitation surface has a large end and a small end. The small end is connected to the paintball outlet. The flow assistor is positioned within the chamber so that during rotation, the large end is adapted for receiving paintballs and the small end is adapted for discharging paintballs out of the outlet. The motor is for driving the flow assistor. The driven means is for connecting the flow assistor to the motor. The delivery conduit is in flow communication with the paintball outlet of the chamber, and with the paintball inlet of the paintball marker when the loader is attached to the paintball marker.

In a fourth aspect, the invention is directed to a loader apparatus for use with a paintball marker having a paintball inlet. The loader apparatus includes a base attachable to the paintball marker, a cartridge having a chamber for paintballs, a delivery conduit, a flow assistor and a battery pack. The base includes a motor and a first mating surface. The cartridge includes a chamber for paintballs. The chamber has a paintball outlet. The delivery conduit is in flow communication with the paintball outlet of the chamber, and with the paintball inlet of the paintball marker when the loader is attached to the paintball marker. The flow assistor assists the flow of paintballs towards the paintball outlet. The motor is for driving the flow assistor. Driven means are included for connecting the flow assistor to the motor. The battery pack includes a housing and a battery which is connectable to the motor by an electrical conduit. The housing includes a second mating surface. Holding means are included for releasably holding the first and second mating surfaces together.

In a fifth aspect, the present invention is directed to a belt for use with a paintball loader apparatus having a base for the mounting of cartridges of paintballs. The belt includes a strap and at least one cartridge mounting assembly connected to the strap. The cartridge mounting assembly is adapted for holding a cartridge. In a preferred embodiment of the third aspect, the belt includes at least one battery pack mounting assembly connected to the strap, for holding a battery pack.

BRIEF DESCRIPTION OF THE DRAWINGS

The present invention will now be described by way of example only with reference to the attached drawings in which.

DETAILED DESCRIPTION OF THE PREFERRED EMBODIMENT

Figure 1:
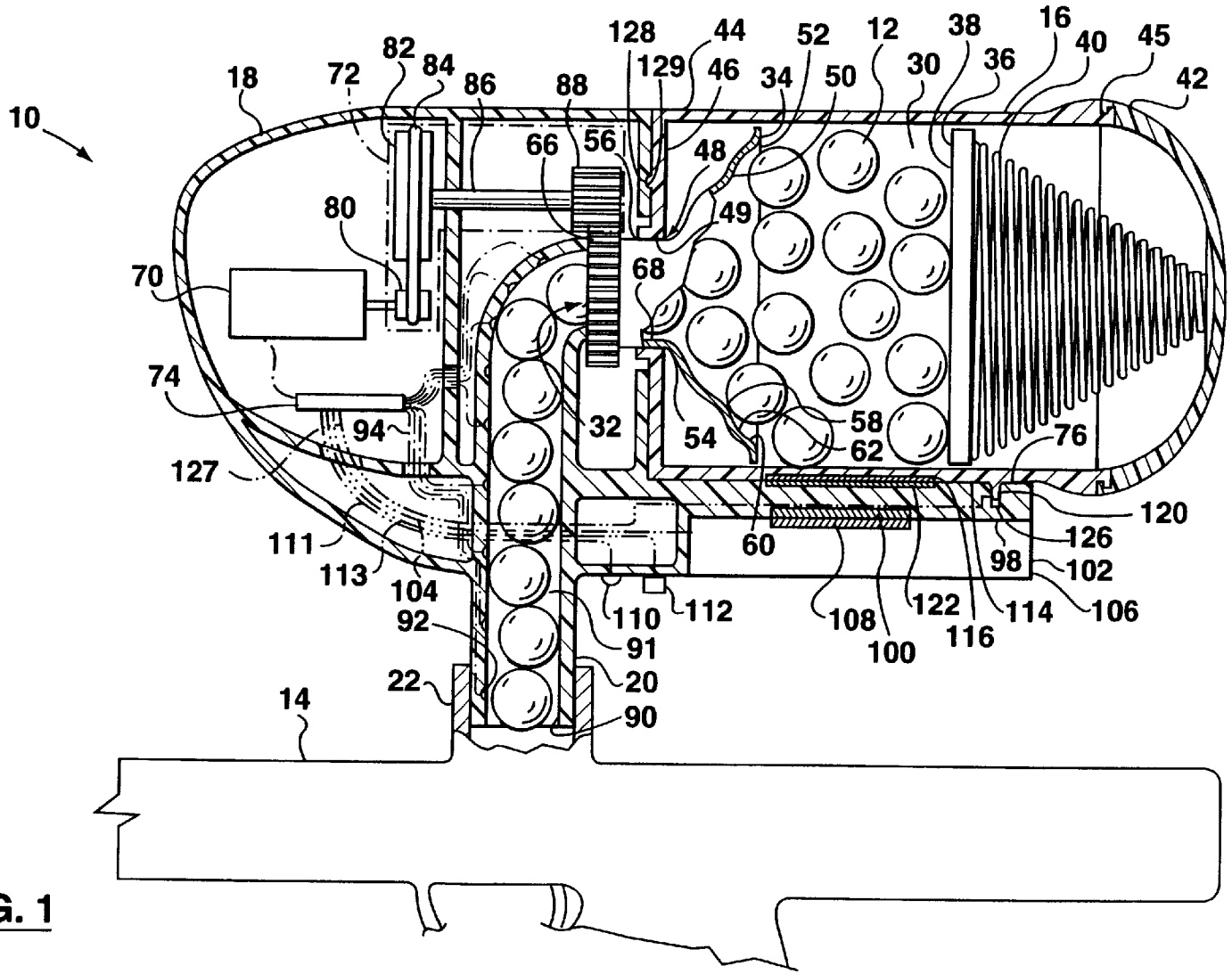
FIG. 1 is a sectional side view of a loader apparatus in accordance with a preferred embodiment of the present invention.

Reference is first made to FIG. 1 which illustrates a loader apparatus 10 made in accordance with a first preferred embodiment of the present invention and which will be used for the purposes of describing the operational aspects of the invention.

Loader 10 is used to hold paintballs 12 and load paintballs 12 into paintball marker 14. Loader 10 comprises a paintball cartridge 16, a base 18 and a delivery conduit 20 which communicates with paintball inlet 22 of paintball marker 14.

Cartridge 16 is removable from base 18 so that when cartridge 16 is empty, a user or player may remove cartridge 16 and replace it with a new one upon base 18. Cartridge 16 comprises a chamber 30 with an outlet 32, a flow assistor 34 and a pressurizing member 36. Chamber 30 holds paintballs 12. An outlet 32 is included in the front wall of chamber 30 and communicates with delivery conduit 20. Pressurizing member 36 maintains a force on paintballs 12 to push paintballs 12 towards outlet 32 of chamber 30. Pressurizing member 36 comprises a pressure plate 38 which is slidable within chamber 30, and a spring 40. Spring 40 acts on pressure plate 38, which contacts paintballs 12, to maintain a compressive force on paintballs 12. Spring 40 is conical shaped which reduces the compressed length of spring 40 thereby reducing the overall size of cartridge 16. By maintaining a compressive force on paintballs 12 the loader apparatus eliminates unwanted noise that can occur from the jiggling of paintballs within a partially full loader of the prior art. Such unwanted noise can inadvertently give away a player's position during a paintball game.

The fixed end of spring 40 is connected to an end cap 42. End cap 42 is removable from body 44 of cartridge 16 so that cartridge 16 is refillable with paintballs 12, preferably when the player is not engaged in play. End cap 42 and body 44 are preferably joined using a bayonet-style connection 45. However, any other style of connection that would enable end cap 42 to be removably attached is acceptable. Cartridge 16 also has an end wall 46 which has an opening 48 surrounded by a bearing portion 49.

Flow assistor 34 is used to assist the flow of paintballs 12 out of outlet 32 by rotating, causing agitation of paintballs 12. The agitation thereby prevents paintballs 12 from wedging at outlet 32. Flow assistor 34 comprises a generally funnel-shaped agitation surface 50 which has a large end 52 which is slightly smaller in diameter than the inside diameter of chamber 30 and an annular small end 54 which is attached to a discharge tube 56. Agitation surface 50 includes surface irregularities 58 which include bosses 60 and dimples 62. Tube 56 passes through opening 48 in end wall 46 and is connected to an annular gear 66. Tube 56 and gear 66 have an inside tubular surface 68, the outlet of which is outlet 32. Tubular surface 68 is of a larger diameter than paintballs 12 but small enough to prevent wedging of paintballs 12.

Base 18 houses the drive and controls for flow assistor 34. Base 18 comprises a motor 70 driving a driven means 72, a controller 74 and a cartridge mounting surface 76. As well, delivery tube 20 is formed integrally with base 18. Base 18 mounts to paintball marker 14 by engaging delivery conduit 20 with marker inlet 22.

Driven means 72 transfers rotational power from motor 70 to gear 66 for driving flow assistor 34. Driven means 72 includes a drive pulley 80, a driven pulley 82, a belt 84, a shaft 86, and a gear 88. Pulley 80 is driven directly by motor 70 and drives pulley 82 by means of belt 84. Shaft 86 extends from the centre of pulley 82 connecting pulley 82 to gear 88. Gear 88 contacts gear 66 when cartridge 16 is mounted on base 18, to drive gear 66 and flow assistor 34. Gear 66 is a second driven means for operatively connecting flow assistor 34 to motor 70.

To assist in the meshing of gears 88 and 66 when cartridge 16 is mounted on base 18, there is play in the fit between gear 88 and gear 66. Furthermore gears 88 and 66 may also include chamfering of the edges of the gear teeth to further assist in their meshing. As well, because pulleys 80 and 82, and belt 84 are incorporated into driven means 72, gear 88 can be rotated as required, taking advantage of belt slippage, in order to further assist in the meshing of gears 88 and 66.

Delivery conduit 20 has an interior surface 90 that defines a passageway 91. Passageway 91 has a diameter larger than paintballs 12 but not so large as to allow the wedging of paintballs 12. Sensors 92 are spaced along the entire length of passageway 91, and are mounted flush with surface 90. Sensors 92 sense the presence of paintballs 12 within passageway 91. Sensors 92 may be infrared sensors or any other sensors that will detect a body such as a paintball 12. Sensors 92 send signals to controller 74 through control lines 94. Control lines 94 schematically represent a suitable electrical connection between sensors 92 and controller 74.

On the bottom of base 18 is a battery pack mounting surface 98, which has a flush-mounted magnetic plate 100 for the mounting of a battery pack 102. Battery pack 102 is removably attached to base 18 and supplies power to controller 74 and to motor 70 through control line 104. Battery pack 102 includes a housing 106 having a magnetic plate 108, which mates with plate 100 on base 18. The magnetic force between plates 100 and 108 help to hold battery pack 102 to base 18. Control line 104 schematically represents a suitable electrical connection between battery pack 102 and controller 74.

Controller 74 receives signals from sensors 92 and operates motor 70 to rotate flow assistor 34 when any of sensors 92 do not detect a paintball 12, suggesting that passageway 91 is not full of paintballs 12. Controller 74 also regulates the voltage of power from battery pack 98 to motor 70. As well, controller 74 monitors the power level in battery pack 98, and illuminates a warning light 110 giving notice to the user, so that the user can change the old battery pack 102 for a fresh one. Warning light 110 is preferably located towards the rear of base 18, so that it can be viewed by the user, but is at least partially hidden from view by others. Warning light 110 is connected to controller 74 by control line 111. Control line 111 schematically represents a suitable electrical connection between light 110 and controller 74.

An on/off switch 112 is included on base 18, and provides the player with manual control for turning controller 74 on and off. Power must pass through controller 74 to reach motor 70. If switch 112 is in the 'off' position, then power is not sent to controller 74 and motor 70, and if switch 112 is in the 'on' position, then power is sent to controller 74, which can in turn send power to motor 70. On/off switch 112 is shown schematically connected to controller 74 by a control line 113. Control line 113 schematically represents a suitable electrical connection permitting manual control of controller 74 using switch 112.

Figure 2A:
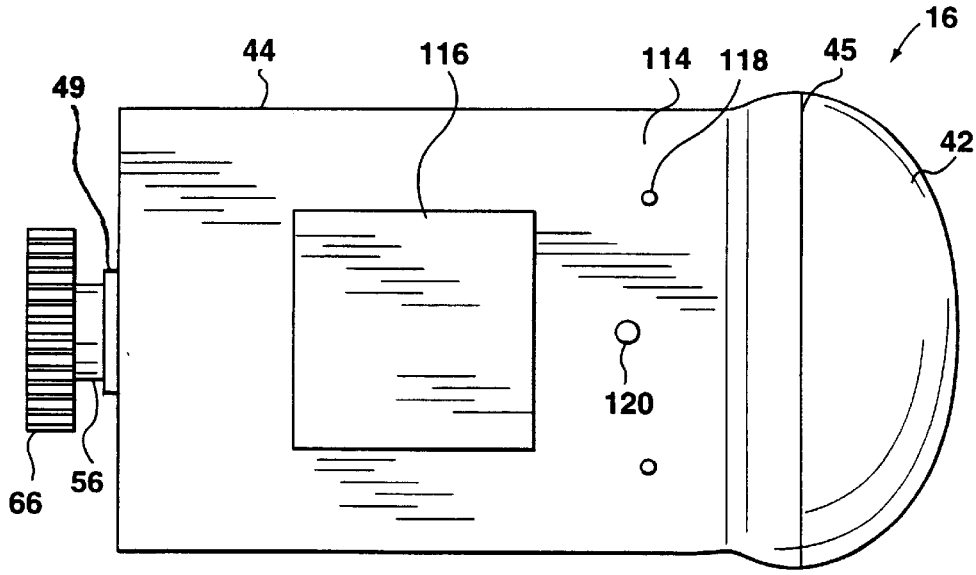
FIG. 2*a* is a bottom plan view of the cartridge of FIG. 1.
Figure 2B:
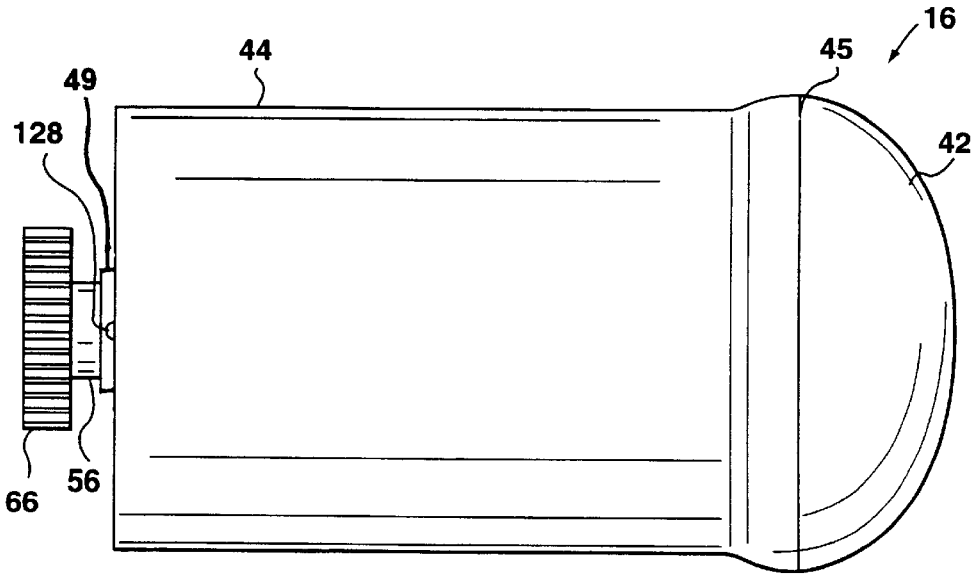
FIG. 2*b* is a top plan view of the cartridge of FIG. 1.
Figure 3:
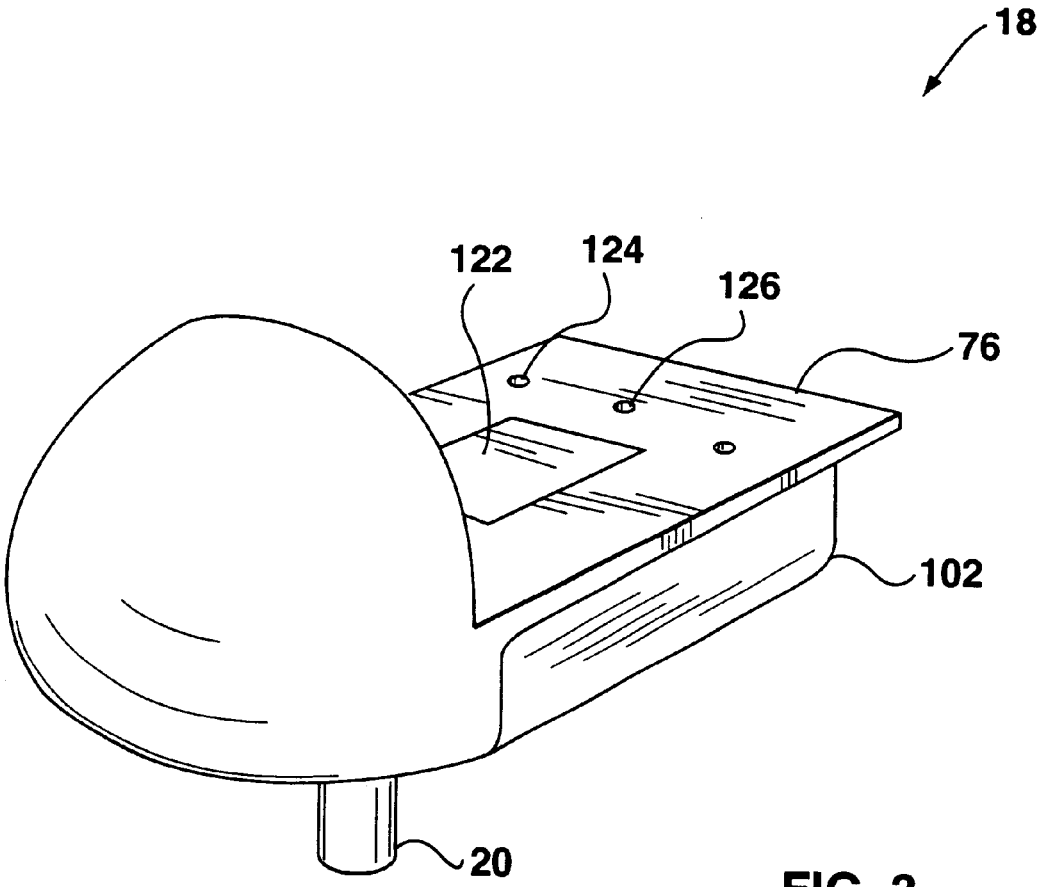
FIG. 3 is a perspective view of the base of FIG. 1.

Reference is now made to FIGS. 2*a*, 2*b* and 3 which show cartridge 16 and base 18 separately. As shown in FIGS. 2*a* and 3, the exterior of cartridge 16 includes a mating surface 114 which mates with mounting surface 76 of base 18. Mating surface 114 includes a magnetic plate 116, two locator bosses 118 and an activator boss 120. Mounting surface 76 of base 18 includes a magnetic plate 122, two locating recesses 124 for receiving locator bosses 118 and an activator switch 126 which is activated when contacted by activator boss 120. Magnetic plates 122 and 116 are of opposite polarity so that they are attracted to each other and are positioned on base 18 and cartridge 16 respectively so that when cartridge 16 is mounted to base 18, magnetic plates 122 and 116 are in contact, helping to retain cartridge 16 in position on base 18. As well, locating bosses 118 and locating recesses 124 further assist in maintaining and positioning cartridge 16 on base 18. Switch 126 effectively detects the presence of cartridge 16 by contact with activator boss 120 and signals the presence to controller 74.

Referring to FIG. 1, when cartridge 16 is mounted on base 18 and boss 120 is in contact with switch 126, a signal is sent to controller 74 through control line 127 indicating that a cartridge 16 is present and that motor 70 can be operated as required. When cartridge 16 is removed from base 18, then controller 74 is notified that cartridge 16 is not present. In the event that controller 74 is prompted to actuate motor 70, (for example, by sensors 92), motor 70 will only be actuated if controller 74 is signalled that a cartridge 16 is present. Switch 126 is connected to controller 74 by a control line 127. Control line 127 schematically represents a suitable electrical connection permitting controller 74 to operate motor 70 when boss 120 contacts switch 126 and preventing the actuation of motor 70 when boss 120 does not contact switch 126.

A summary description of the logic by which controller 74 operates motor 70 will now be provided. When switch 112 is 'off', when switch 126 is not contacted by activator boss 120, or when battery pack 102 does not have enough power, then controller 74 cannot operate motor 70. When switch 112 is 'on', when switch 126 is contacted by boss 120 and when battery pack 102 has enough power, controller 74 can operate motor 70. When any of sensors 92 detect a gap between paintballs 12 in passageway 91, then controller 74 operates motor 70 (and flow controller 34), provided that switch 112 is 'on', battery pack 102 has enough power, and switch 126 is contacted by boss 120.

As shown in FIGS. 1 and 2*b*, cartridge 16 includes a boss 128 which mates with a recess 129 on base 18. Boss 128 and recess 129 together with magnetic plates 116 and 122, and bosses 118 and recesses 124, help keep cartridge 16 positioned on base 18.

Figure 4B:
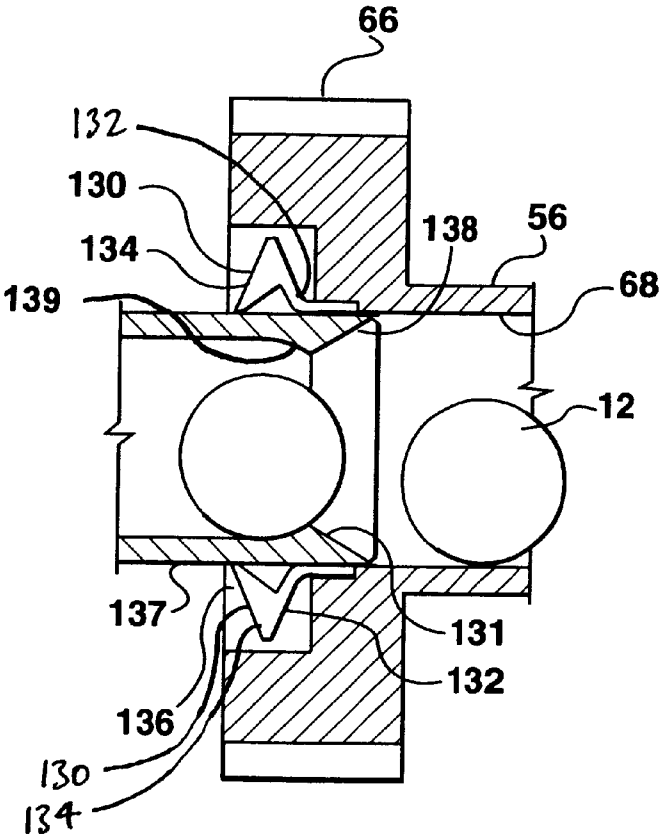
FIG. 4*b* is a side view of the outlet and inlet portions shown in FIG. 4*a*, when the cartridge is mounted on the base.
Figure 4A:
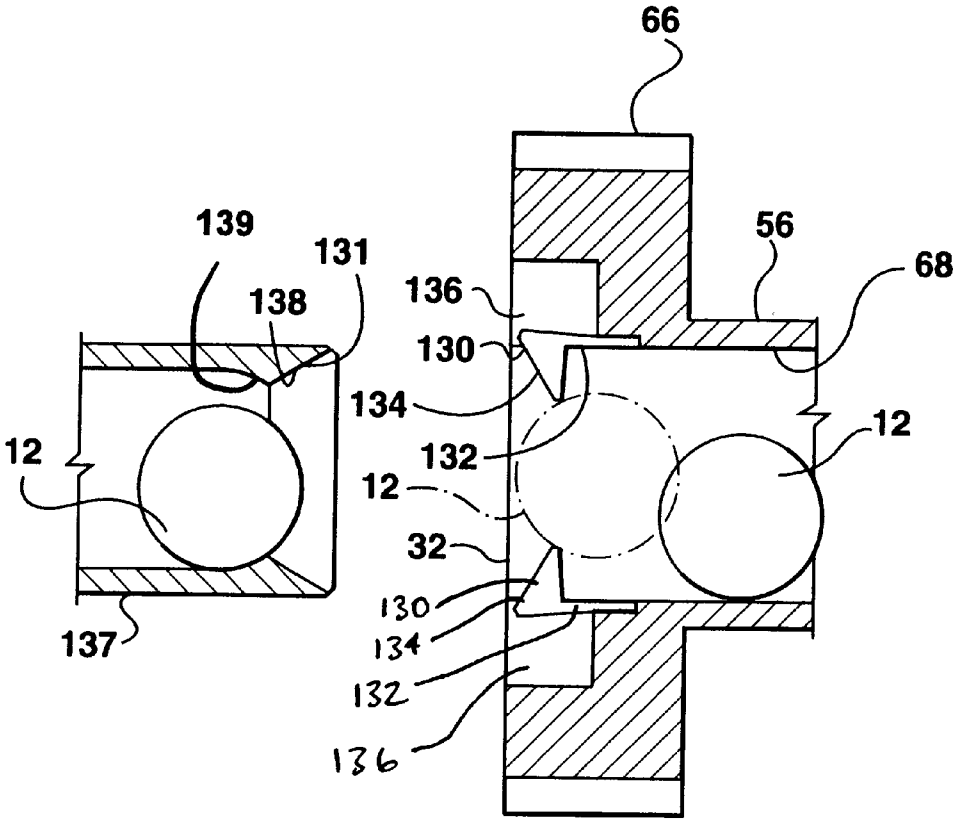
FIG. 4*a* is a side view of the outlet portion of the cartridge of FIG. 1 and the inlet portion of the delivery conduit of FIG. 1, when the cartridge is removed from the base.

Reference is now made to FIGS. 4*a* and 4*b* which show a sectional side view of gear 66 and discharge tube 56, and which show flow preventers 130 and 131. As shown in FIG. 4*a*, cartridge flow preventer 130 and base flow preventer 131 prevent the spillage of paintballs 12 from outlet 32 and from the inlet of passageway 91 respectively, when cartridge 16 is not mounted on base 18. FIG. 4*b* shows flow preventers 130 and 131 when cartridge 16 is mounted on base 18.

Cartridge flow preventer 130 comprises retractable stops. The stops extend radially inwards from surface 68 to prevent the flow of paintballs out from outlet 32. The stops can be retracted, however, to permit the flow of paintballs out from the outlet 32. The stops include a plurality of arms 132 which are made from a resilient flexible material. Such a material is preferably a resilient flexible polymer, which will not damage paintballs 12. Arms 132 are mounted fixed at one end into surface 68 and include wedge shaped nubs 134. Nubs 134 project into outlet 32 as shown in FIG. 4*a* when cartridge 16 is not mounted on base 18, preventing the flow of paintballs 12 through outlet 32. Cartridge flow preventer 130 therefore prevents the flow of paintballs 12 through outlet 32 when cartridge 16 is not mounted on base 18. A recess 136 is included underneath the free end of each of arms 132. Recess 136 is sized so that if arm 132 was depressed as shown in FIG. 4*b*, no part of arm 132 or nub 134 would project into outlet 32. As shown in FIG. 4*b*, when cartridge 16 is mounted on base 18, a passageway inlet tube 137 which projects from base 18 and which communicates with passageway 91, projects into outlet 32, pushing nubs 134 and arms 132 into recesses 136, allowing paintballs 12 to flow through outlet 32.

When cartridge 16 is removed from base 18, the arms 132 return to their original position to extend radially inwards from surface 68, due to their resiliency, so that they prevent the flow of paintballs from outlet 32.

Base flow preventer 131 includes a leading edge surface 138 and a trailing edge surface 139. Preferably as shown in FIGS. 4*a* and 4*b*, surface 138 slopes smoothly from a diameter substantially equal to that of tubular surface 68, to a diameter slightly larger than paintballs 12. The trailing edge surface 139 of flow preventer 131 is preferably contoured to hold and partially cup a paintball 12, to inhibit paintball 12 from rolling backwards out of the inlet of passageway 91. Together, surfaces 138 and 139 permit the entry of paintballs 12 into the inlet of passageway 91, but inhibit paintballs 12 from rolling out of the inlet of passageway 91.

Figure 5:
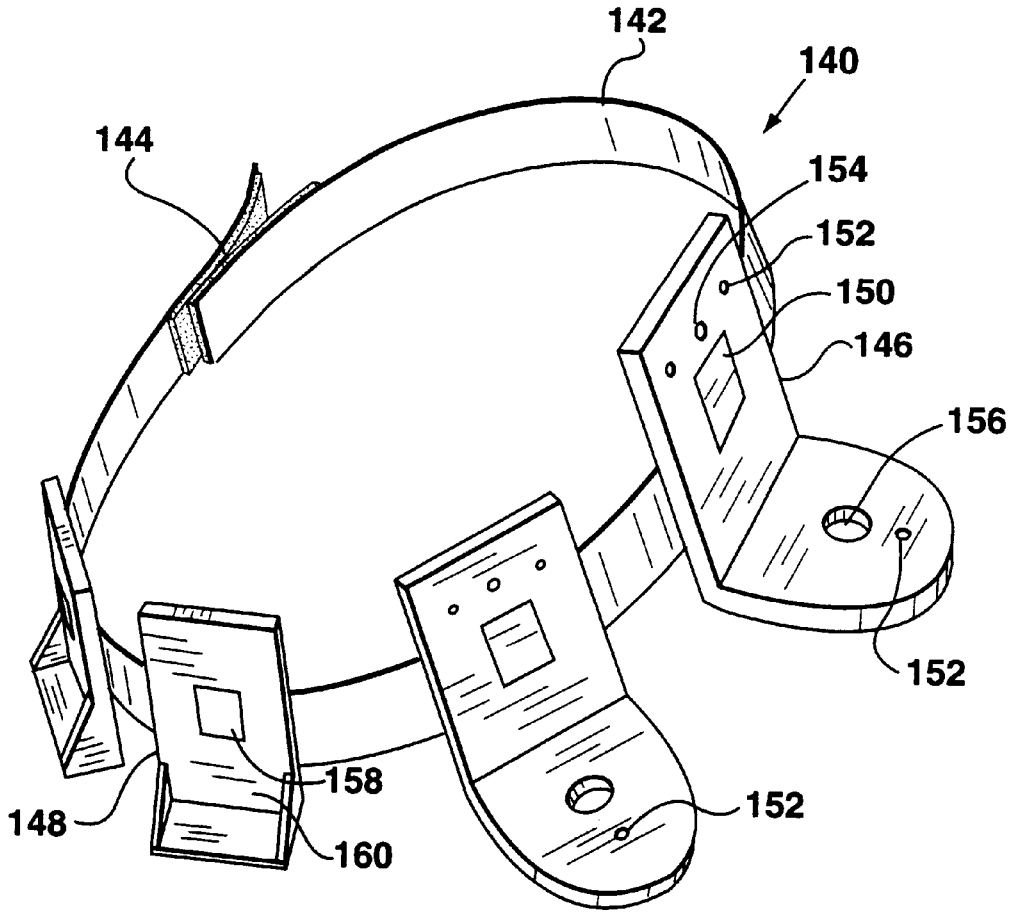
FIG. 5 is a perspective view of a storage belt for cartridges and battery packs.

Reference is now made to FIG. 5 which shows a belt 140 which can be worn by the player and which stores both spent and full replacement cartridges 16. Belt 140 comprises a strap 142, a closure 144 such as Velcro (TM), a plurality of mounting assemblies 146 for receiving spent or fresh cartridges 16, and a plurality of mounting assemblies 148 for holding spent or fresh battery packs 102. Mounting assembly 146 includes a magnetic plate 150 for contacting magnetic plate 116 on cartridge 16, and two locating recesses 152 for receiving locating bosses 118 and a locating recess 154 for receiving activator boss 120. As well, mounting assembly 146 includes an opening 156 for gear 66. Mounting assembly 148 includes a magnetic plate 158 that is mounted in a receiving surface 160 for battery pack 102.

Figure 6:
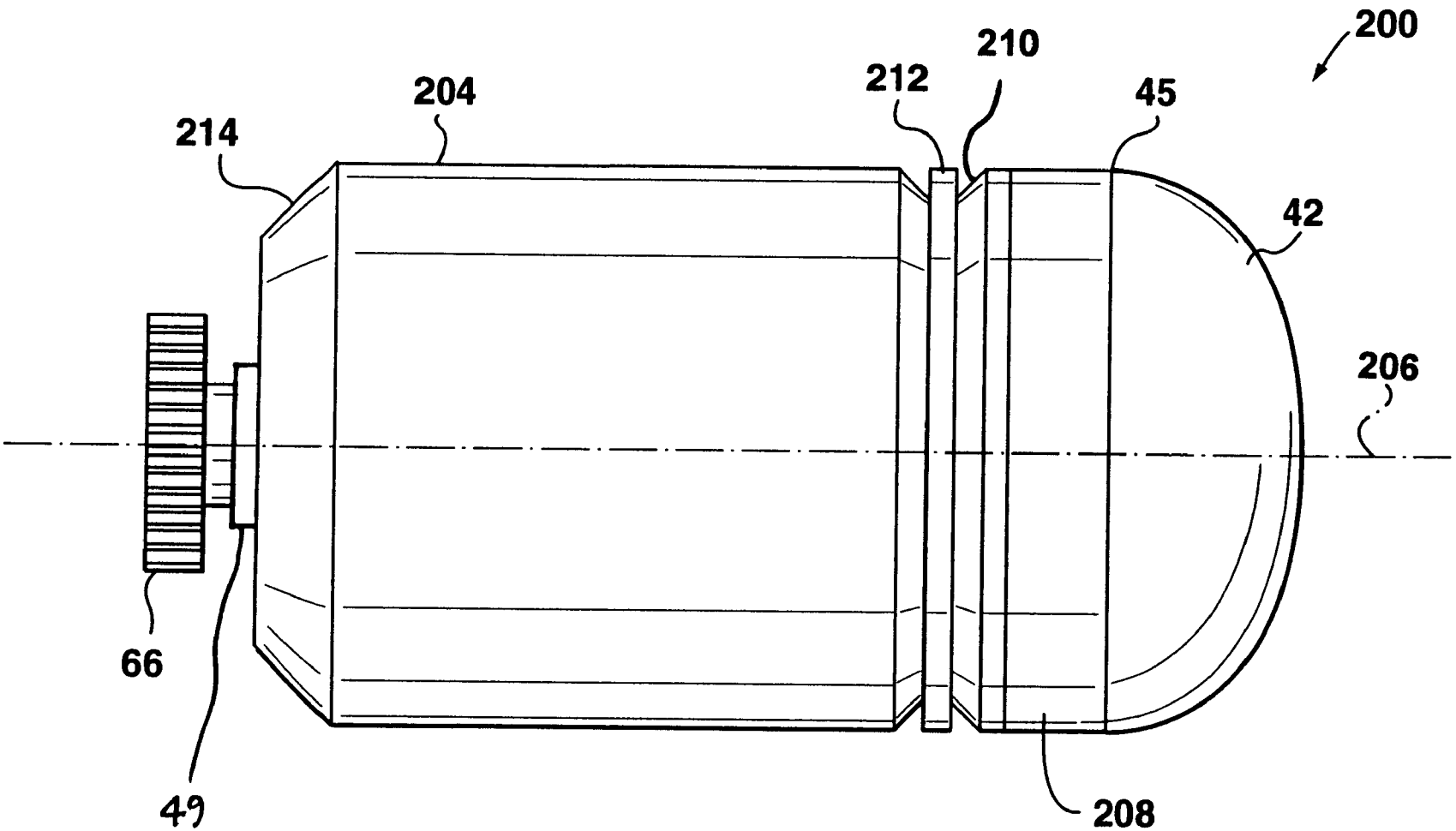
FIG. 6 is a top plan view of a cartridge in accordance with an alternate embodiment of the present invention.
Figure 7:
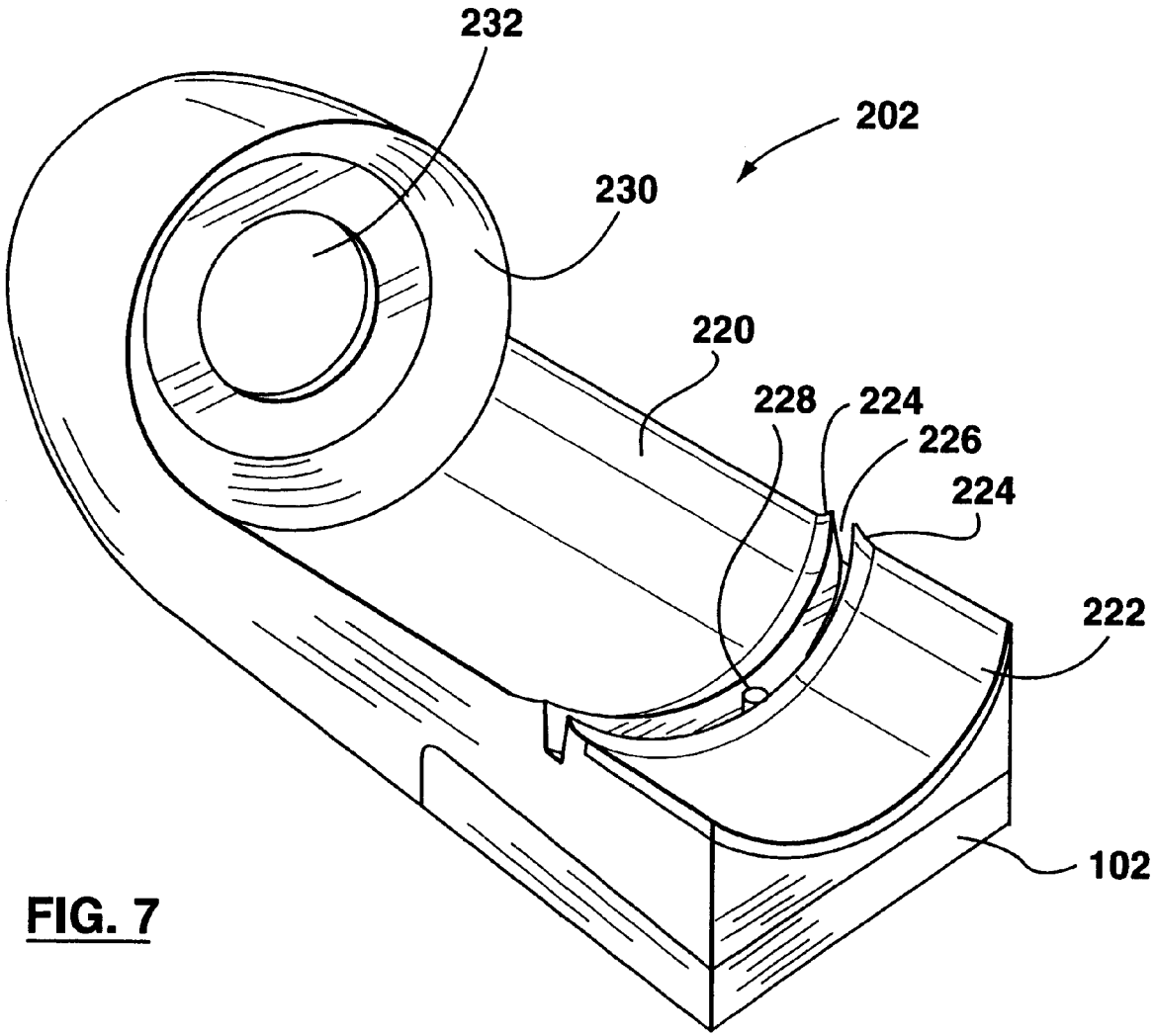
FIG. 7 is a perspective view of a base in accordance with an alternate embodiment of the present invention.

Reference is now made to FIGS. 6 and 7, which show a cartridge 200 and a base 202 in accordance with another preferred embodiment of the present invention. Cartridge 200 is similar to cartridge 16, except as follows. Cartridge 200 has a body 204 that is generally cylindrical about an axis 206. A magnetic plate 208 extends around the circumference of body 204. A depression ring 210 extends around the circumference of body 204. An activator flange 212 extends radially outwardly from depression ring 210, and preferably does not extend radially past the outer diameter of body 204. By having a flange 212 that does not extend past the outer diameter of body 204, the flange is less prone to damage in the event that cartridge 200 is dropped. The forward end of cartridge 200 has a chamfered surface 214 that extends around the circumference of body 204.

Base 202 is similar to base 18 except as follows. Base 202 includes a generally part-cylindrically shaped cartridge mounting surface 220 that is shaped to mate with the generally cylindrical shaped body 204 of cartridge 200. A magnetic plate 222 that is generally part-cylindrically shaped is incorporated into mounting surface 220. Magnetic plate 222 mates with a portion of magnetic plate 208 on cartridge 200 to help hold cartridge 200 on base 202 when cartridge 200 is mounted to base 202. Mounting surface 220 also includes a pair of raised ridges 224, which define a groove 226. Inside groove 226 is an activation switch 228. Ridges 224 fit within a portion of depression ring 210 on either side of flange 212 on cartridge 200. Flange 212 is thus received in groove 226 and contacts activation switch 228, to indicate to the controller (not shown) in base 202 that cartridge 200 is present. Base 202 also includes a chamfered hood portion 230, which receives chamfered edge 214 on cartridge 200. By having chamfered hood 214 and by having chamfered forward edge 214, the mounting of cartridge 200 onto base 202 is facilitated. A hole 232 in base 202 receives gear 66 from cartridge 200, so that gear 66 can connect to the internal drive mechanism (not shown) within base 202. Battery pack 102 mounts as before to base 202.

Cartridge 200 can be mounted onto base 202, while cartridge 200 is in any circumferential orientation about axis 206, thus facilitating the mounting of cartridge 200 onto base 202.

In a preferred embodiment, activator flange 212 is recessed in depression ring 210, and does not extend past the outer diameter of body 204. Alternatively, however, body 204 may have no depression and activator flange 212 may extend from body 204, thus extending past the outer diameter of body 204.

In a preferred embodiment, delivery conduit 20 to be included integrally with base 18, the loader can alternatively include a separate base and separate delivery conduit. In this alternative embodiment, the delivery conduit can mount to the inlet of a paintball marker separately, and the base can then mount to the delivery conduit, for receiving cartridges. Alternatively, the separate delivery conduit can mount to the base, and then the base/conduit assembly can mount to the inlet of a paintball marker.

Preferably, a plurality of sensors 92 are included within passageway 91. Alternatively, a single sensor may be included in passageway 91.

In a preferred embodiment, spring 40 and pressure plate 38 are used to urge paintballs 12 towards outlet 32. Alternatively, any other pressurizing means can be used to maintain a compressive force on paintballs 12 and to urge them towards outlet 32 while ensuring that the compressive force is not so large as to damage paintballs 12.

In a preferred embodiment, tube 56 rotates directly against bearing portion 49. The apparatus can alternatively have a tube, a bearing portion and a bearing, (e.g. a ball bearing) in between the tube and the bearing portion. Any other suitable bearing means can be used.

In a preferred embodiment, flow assistor 34 includes agitation surface 50 with bosses 60 and dimples 62 in order to agitate paintballs 12 and assist flow. In an alternative embodiment, the agitation surface may include only bosses 60. In another alternative, the agitation surface may include only dimples 62. Alternatively, any other suitable flow assistance means may be used.

In an alternative embodiment, the loader apparatus includes a cartridge and base, the cartridge having paintball chamber and a flow assistor 34 mounted therein, the flow assistor being driven by a motor, similar to the embodiment shown in FIG. 1. In this alternative embodiment however, the cartridge may be fixed permanently to the base, or may be removable therefrom.

In an alternative embodiment, not shown, cartridge flow preventer 130 comprises spring plungers, (eg. ball plungers), spaced circumferentially around surface 68, instead of arms 132 and recesses 136. The plungers would extend radially inwards in outlet 32 to prevent paintballs 12 from spilling out of outlet 32, when the cartridge is not mounted to the base. The plungers would be compressed out of the way by passageway inlet 137, when the cartridge is mounted to the base, so that the plungers would not inhibit the flow of paintballs. As another alternative, cartridge flow preventer 130 can comprise resilient, flexible wires that would be shaped substantially as a mirror image to flow preventer 131. Such wires would preferably have a slope surface similar to surface 138, so that they would be pushed radially out of the way by inlet 137 when the cartridge is mounted to the base.

In a preferred embodiment, magnets hold the cartridge on the base. Alternatively, a single magnet and a ferrous metallic plate could be used or a magnet and any other material that is attracted magnetically to a magnet can alternatively be used. Alternatively, another retaining structure may be used, such as a hook and loop fabric material (Velcro TM). Similarly, a magnet and a ferrous metallic plate, or a hook and loop fabric material can alternatively be used to hold the battery pack to the base.

In a preferred embodiment, the driven means include pulleys, a belt, and meshing gears between motor 70 and flow assistor 34. Alternatively, different driven means may be incorporated, such as a magnetic drive, or simply two gears.

Providing a paintball loader apparatus with a pressurizing member to push the paintballs towards the outlet of the loader, reduces unwanted noise from the paintballs contained therein, and further allows the paintball marker to be fired while in any orientation. Furthermore, providing the apparatus with a base and a quickly removable cartridge provides the user with the utility of a quick, inexpensive way of refitting the marker with a fresh paintball supply, while maintaining the advantages inherent in a motorized discharging means. Furthermore, providing a quickly removable battery pack provides the user with the ability to quickly replace the battery pack to continue game play.

As will be apparent to persons skilled in the art, various modifications and adaptations of the apparatus described above may be made without departure from the present invention, the scope of which is defined in the appended claims.

I claim:

1. A loader apparatus for use with a paintball marker having a paintball inlet, the loader apparatus comprising:

a base attachable to said paintball marker, a cartridge removably attachable to said base, and a delivery conduit, said base including a motor and a first driven means operatively connected to said motor, said cartridge including a chamber for paintballs, said chamber defining a paintball outlet, said cartridge further including a flow assistor and a second driven means operatively connected to said flow assistor, said second driven means being operatively connected to said first driven means when said cartridge is attached to said base, and wherein said delivery conduit is in flow communication with said paintball outlet of said chamber and with said paintball inlet of said paintball marker when said cartridge is attached to said base and said base is mounted on said paintball marker.

2. A loader apparatus as claimed in claim 1, wherein said loader apparatus further comprises a pressurizing member for maintaining a force on said paintballs in said chamber to urge said paintballs towards said paintball outlet.

3. A loader apparatus as claimed in claim 2, wherein said pressurizing member comprises a spring, said spring being operatively connected to said paintballs, so that said spring is adapted to act on said paintballs to force said paintballs towards said paintball outlet.

4. A loader apparatus as claimed in claim 1, wherein said flow assistor comprises a generally funnel-shaped surface surrounding said paintball outlet, said generally funnel-shaped surface comprising surface irregularities for agitating paintballs.

5. A loader apparatus as claimed in claim 1, wherein said motor is an electric motor.

6. A loader apparatus as claimed in claim 1, wherein said base further comprises a first mating surface, and said cartridge further comprises a second mating surface, which contacts said first mating surface when said cartridge is mounted on said base, and said apparatus further comprises holding means for releasably holding said first and second mating surfaces together.

7. A loader apparatus as claimed in claim 6, wherein said second mating surface is generally cylindrical about an axis and said first mating surface has a generally part cylindrical shape for receiving a portion of said second mating surface, so that said cartridge can be mounted on said base in any orientation about said axis.

8. A loader apparatus as claimed in claim 7, wherein said cartridge further comprises a radially extending flange on said second mating surface, and said base includes a groove on said first mating surface for receiving a portion of said flange, to inhibit slippage of said cartridge from said base, when said cartridge is mounted thereon.

9. A loader apparatus as claimed in claim 8, wherein said base further comprises a switch in said groove, which is engaged by said flange of said cartridge when said cartridge is mounted on said base, and said switch is operatively connected to said motor, and is adapted to prevent the operation of said motor when said cartridge is separated from said base.

10. A loader apparatus as claimed in claim 8, wherein said cartridge has a recess extending circumferentially about said second mating surface, and said flange extends from the base of said recess, so that the radially outward edge of said flange is located within said recess.

11. A loader apparatus as claimed in claim 6, wherein said holding means comprises a magnet, and a material that is magnetically attracted to said magnet.

12. A loader apparatus as claimed in claim 1, wherein said delivery conduit comprises a flow conduit for paintballs.

13. A loader apparatus as claimed in claim 12, wherein said flow conduit comprises at least one paintball sensor for detecting the presence of paintballs in said flow conduit, said at least one sensor is operatively connected to said motor so that said sensor activates said motor when said sensor does not detect the presence of a paintball.

14. A loader apparatus as claimed in claim 12, wherein said paintball outlet comprises retractable stops positioned in said paintball outlet, said stops being adapted to retract from said paintball outlet to allow the passage of paintballs when said cartridge is attached to said base, and said stops being adapted to extend into said outlet to prevent the passage of paintballs when said cartridge is unattached from said base.

15. A loader apparatus as claimed in claim 1, wherein said second driven means comprises a gear, and said first driven means comprises a gear.

16. A loader apparatus as claimed in claim 1, wherein said delivery conduit is integrally joined with said base.

17. A loader apparatus as claimed in claim 1, wherein said base comprises a switch, which is engaged by said cartridge when said cartridge is mounted on said base, said switch is operatively connected to said motor, and is adapted to prevent the operation of said motor when said cartridge is separated from said base.

18. A loader apparatus for use with a paintball marker having a paintball inlet, the loader apparatus comprising:

a cartridge and a delivery conduit, said cartridge including a chamber for paintballs, said chamber defining a paintball outlet, and a pressurizing member for maintaining a force on said paintballs in said chamber to urge said paintballs in said chamber towards said paintball outlet, wherein said pressurizing member is adapted to contact a plurality of paintballs simultaneously, and said delivery conduit being in flow communication with said paintball outlet of said chamber and with said paintball inlet of said paintball marker when said cartridge is attached to said paintball marker.

19. A loader apparatus as claimed in claim 18, further comprising a base attachable to said paintball marker and said cartridge is attachable to said base, said base including a motor and a first driven means operatively connected to said motor, wherein said cartridge includes a flow assistor and a second driven means operatively connected to said flow assistor, said second driven means being operatively connected to said first driven means when said cartridge is attached to said base.

20. A loader apparatus as claimed in claim 18, wherein said pressurizing member comprises a spring, said spring being operatively connected to said paintballs, so that said spring is adapted to act on said paintballs to force said paintballs towards said paintball outlet.

21. A loader apparatus as claimed in claim 18, wherein said delivery conduit comprises a flow conduit for paintballs.

22. A loader apparatus as claimed in claim 21, wherein said flow conduit comprises at least one paintball sensor for detecting the presence of paintballs in said flow conduit, said at least one sensor is operatively connected to said motor so that said sensor activates said motor when said sensor does not detect the presence of a paintball.

23. A loader apparatus as claimed in claim 21, wherein said paintball outlet comprises retractable stops positioned in said paintball outlet, said stops being adapted to retract from said paintball outlet to allow the passage of paintballs when said cartridge is attached to said base, and said stops being adapted to extend into said outlet to prevent the passage of paintballs when said cartridge is unattached from said base.

24. A loader apparatus for use with a paintball marker having a paintball inlet, the loader apparatus comprising:

a base attachable to said paintball marker, said base including a motor and a first mating surface;

a cartridge attached to said base, said cartridge including a chamber for paintballs, said chamber defining a paintball outlet;

a delivery conduit, said delivery conduit being in flow communication with said paintball outlet and with said paintball inlet of said paintball marker when said loader apparatus is mounted on said paintball marker;

a flow assistor attached to said chamber for assisting the flow of paintballs towards said paintball outlet;

driven means, operatively connecting said flow assistor to said motor;

a battery pack including a housing and a battery, said housing including a second mating surface, said battery pack connectable to said motor by an electrical conduit; and holding means for releasably holding said first and second mating surfaces together.

25. A loader apparatus as claimed in claim 24, wherein said holding means comprises a magnet, and a material that is magnetically attracted to said magnet.

26. A loader apparatus as claimed in claim 24, wherein said base includes a first driven means operatively connected to said motor, and said cartridge further includes a second driven means operatively connected to said flow assistor, said second driven means being operatively connected to said first driven means when said cartridge is attached to said base, and wherein said cartridge is removably attachable to said base.

27. A loader apparatus as claimed in claim 24, wherein said loader apparatus further comprises a pressurizing member for maintaining a force on said paintballs in said chamber to urge said paintballs towards said paintball outlet.

28. A loader apparatus as claimed in claim 27, wherein said pressurizing member comprises a spring, said spring being operatively connected to said paintballs, so that said spring is adapted to act on said paintballs to force said paintballs towards said paintball outlet.

29. A loader apparatus as claimed in claim 24, wherein said flow assistor comprises a generally funnel-shaped surface surrounding said paintball outlet, said generally funnel-shaped surface comprising surface irregularities for agitating paintballs.

30. A loader apparatus as claimed in claim 24, wherein said motor is an electric motor.

31. A loader apparatus as claimed in claim 24, wherein said delivery conduit comprises a flow conduit for paintballs.

32. A loader apparatus as claimed in claim 31, wherein said flow conduit comprises at least one paintball sensor for detecting the presence of paintballs in said flow conduit, said at least one sensor is operatively connected to said motor so that said sensor activates said motor when said sensor does not detect the presence of a paintball.

33. A loader apparatus for use with a paintball marker having a paintball inlet, the loader apparatus comprising:

a cartridge, said cartridge including a chamber for paintballs, said chamber defining a paintball outlet;

a delivery conduit, said delivery conduit being in flow communication with said paintball outlet and with said paintball inlet of said paintball marker when said loader apparatus is mounted on said paintball marker;

a rotatable flow assistor, said flow assistor having a funnel shaped agitation surface for agitating paintballs, said agitation surface having a large end and a small end, said small end connected to said paintball outlet, said flow assistor being attached to said cartridge so that, during rotation, said large end is adapted for receiving paintballs and said small end is adapted for discharging paintballs out of said outlet;

a motor for driving said flow assistor; and driven means for connecting said flow assistor to said motor.

34. A loader apparatus as claimed in claim 33, wherein said large end has substantially the same diameter as said chamber.

35. A loader apparatus as claimed in claim 33, wherein said agitation surface comprises a plurality of bosses to enhance the agitation of paintballs during rotation of said flow assistor.

36. A loader apparatus as claimed in claim 33, wherein said agitation surface comprises a plurality of dimples to enhance the agitation of paintballs during rotation of said flow assistor.

37. A loader apparatus as claimed in claim 33, wherein said agitation surface comprises a plurality of bosses and dimples to enhance the agitation of paintballs during rotation of the flow assistor.

38. A loader apparatus as claimed in claim 33, further comprising a base, said base including a motor and a first driven means operatively connected to said motor, wherein said cartridge is removably attachable to said base and said cartridge includes a second driven means operatively connected to said flow assistor, said second driven means being operatively connected to said first driven means when said cartridge is attached to said base.

39. A loader apparatus as claimed in claim 33, wherein said loader apparatus further comprises a pressurizing member for maintaining a force on said paintballs in said chamber to urge said paintballs towards said paintball outlet.

40. A loader apparatus as claimed in claim 39, wherein said pressurizing member comprises a spring, said spring being operatively connected to said paintballs, so that said spring is adapted to act on said paintballs to force said paintballs towards said paintball outlet.

41. A loader apparatus as claimed in claim 33, wherein said motor is an electric motor.

42. A loader apparatus as claimed in claim 33, wherein said delivery conduit comprises a flow conduit for paintballs.

43. A loader apparatus as claimed in claim 33, wherein said flow conduit comprises at least one paintball sensor for detecting the presence of paintballs in said flow conduit, said at least one sensor is operatively connected to said motor so that said sensor activates said motor when said sensor does not detect the presence of a paintball.

44. A loader apparatus for use with a paintball marker having a paintball inlet, the loader apparatus comprising:

a base attachable to said paintball marker, a cartridge removably attachable to said base, and a delivery conduit, said base including a motor and a first driven means operatively connected to said motor, said cartridge including a chamber for paintballs, said chamber defining a paintball outlet, said cartridge further including a pressurizing member for maintaining a force on said paintballs in said chamber to urge said paintballs towards said paintball outlet, said cartridge further including a flow assistor and a second driven means operatively connected to said flow assistor, said second driven means being operatively connected to said first driven means when said cartridge is attached to said base, and wherein said delivery conduit is in flow communication with said paintball outlet of said chamber and with said paintball inlet of said paintball marker when said cartridge is attached to said base and said base is mounted on said paintball marker.

45. A loader apparatus for use with a paintball marker having a paintball inlet, the loader apparatus comprising:

a base attachable to said paintball marker, a cartridge removably attachable to said base, holding means for removably holding said cartridge to said base and a delivery conduit, said base including a motor and a first driven means operatively connected to said motor, said base further including a first mating surface, said cartridge including a chamber for paintballs, said chamber defining a paintball outlet, said cartridge further including a pressurizing member for maintaining a force on said paintballs in said chamber to urge said paintballs towards said paintball outlet, said cartridge further including a flow assistor and a second driven means operatively connected to said flow assistor, said second driven means being operatively connected to said first driven means when said cartridge is attached to said base, said cartridge further including a second mating surface that mates with said first mating surface on said base;

said holding means including a magnet attached to one of said first and second mating surfaces and a material that is attracted to said magnet attached to the other of said first and second mating surfaces, and wherein said delivery conduit is in flow communication with said paintball outlet of said chamber and with said paintball inlet of said paintball marker when said cartridge is attached to said base and said base is mounted on said paintball marker.

* * * * *